United States Patent [19]

Santo

[11] Patent Number: 4,729,136

[45] Date of Patent: Mar. 8, 1988

[54] UNIVERSAL SLEEP SYSTEM SUPPORT

[76] Inventor: Philip J. Santo, 12 Mountin Rd., Rochester, N.Y. 14625

[21] Appl. No.: 902,778

[22] Filed: Sep. 2, 1986

[51] Int. Cl.[4] ..... A47C 19/04

[52] U.S. Cl. ..... 5/201; 5/203; 5/285; 5/286; 5/280; 5/308; 5/400

[58] Field of Search ..... 5/201, 200 R, 200 B, 5/200 C, 451, 282 R, 285, 286, 280, 203, 308, 400, 401

[56] References Cited

U.S. PATENT DOCUMENTS

| | | | |
|---|---|---|---|
| 3,546,725 | 12/1970 | Tambascio | 5/280 |
| 4,110,854 | 9/1978 | Sjolie | 5/308 |
| 4,263,683 | 4/1981 | Knoke | 5/200 R |
| 4,391,008 | 7/1983 | Yamaoka et al. | 5/200 R |
| 4,597,117 | 7/1986 | Sumner | 5/308 |
| 4,613,999 | 9/1986 | Franco et al. | 5/201 |
| 4,675,929 | 6/1987 | Santo | 5/400 |

*Primary Examiner*—Alexander Grosz
*Attorney, Agent, or Firm*—Lawrence P. Kessler

[57] ABSTRACT

A universal sleep system support which is readily collapsible for storage and transportation, and is easily assembled into a construction which can support any type and common size of sleep system. This universal sleep system support comprises a plurality of modules which when assembled are selectively locked together into a unitary construction. The modules each include readily assembled corner pieces and channel units. The corner pieces respectively have a planar surface and a leg structure extending substantially perpendicularly therefrom; and the channel units respectively have mating members slideably associated with one another for adjusting the length of the channel units. The channel units are selectively received by the corner pieces and adjusted to a preselected length to set the distance between such corner pieces. The assembled modules are selectively locked together into the unitary construction so that the channel units can support any type of sleep system of any common size. In a further aspect of this invention, pairs of corner pieces are interconnected by adjustable brace members to provide structural rigidity therebetween. Also, the leg structures may include mechanisms for securing adjustable decorative panels thereto. The panels serve to give the universal support any desired appearance and may also provide a mounting means for an under-bed drawer storage assembly.

10 Claims, 11 Drawing Figures

FIG. 1
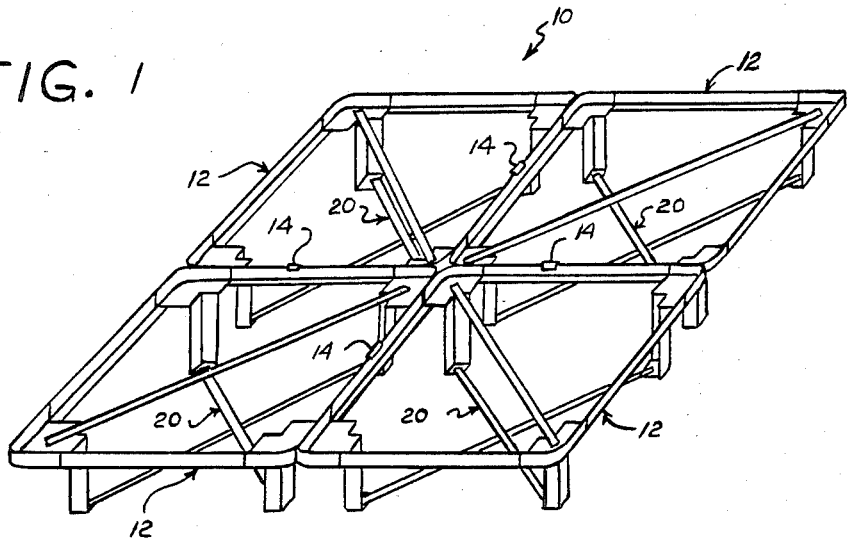
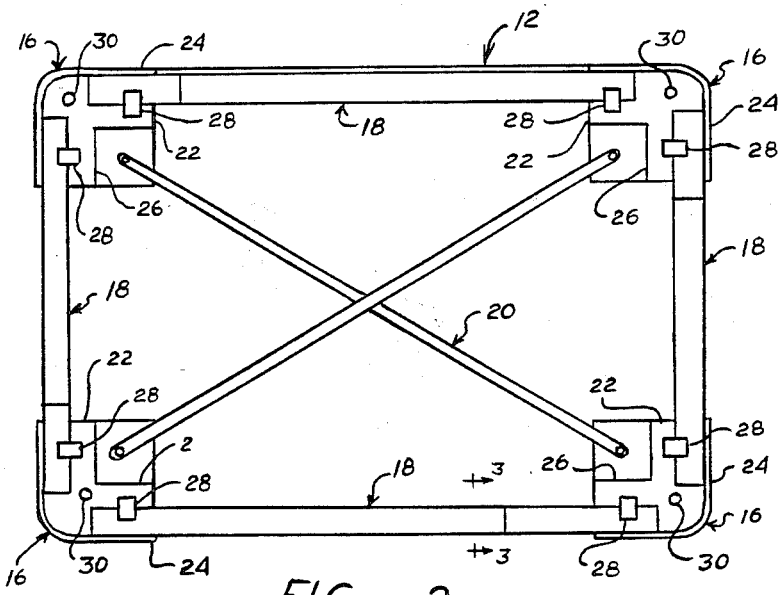
FIG. 2

UNIVERSAL SLEEP SYSTEM SUPPORT

BACKGROUND OF THE INVENTION

This invention relates generally to sleep system supports, and more particularly to a universal sleep system support which is readily collapsible into a compact configuration for storage and transport and easy to assemble into a configuration adapted to support any size and type of sleep system.

In the bedding industry, sleep systems are generally categorized as being of three major classifications: conventional, floatation, or hybrid. Conventional sleep systems include stuffed or foam-filled mattresses supported on box spring assemblies, while floatation sleep systems employ fluid-filled, flexible-walled bladders. Hybrid sleep systems are basically a combination of the first two types of sleep systems, with a fluid-filled bladder supported in an assembly including a stuffed or foam-filled marginal perimeter support for the bladder.

Each of these sleep systems typically requires some sort of under-bed support, at a customer's site, to locate the sleep surface at a preferred height. Because the sleep systems come in a variety of sizes, the associated supports must be capable of supporting such various size systems. This has always presented a multiplicity of problems to the bedding industry. Specifically, it has necessitated stocking a wide variety of supports, which are generally large so as to require considerable storage space and are difficult to transport to a customer's site; or if capable of being broken down into smaller component parts, to facilitate transport and storage, are difficult to assemble by the customer at his/her site.

There have been many attempts to modify sleep system supports to make them adjustable, more readily transportable, and easier to assemble. However, typical supports in use today have been dedicated to either conventional sleep systems or floatation sleep systems. That is to say, such supports can only be used for one type of sleep system. For example, supports for conventional sleep systems in common use today include an adjustable marginal perimeter frame which can accomodate several sizes of sleep surfaces. While these frames can typically be broken down for transportation, some of their component parts are still cumbersome to handle. On the other hand, attempts to improve the transportability and ease of assembly of supports for floatation sleep systems (and hybrid sleep system which typically employ similar types of supports) include, for example, my U.S. Pat. No. 4,224,705, issued Sept. 30, 1980, and my co-pending U.S. patent application Ser. No. 712,629, filed Mar. 18, 1985 now U.S. Pat. No. 4,675,929. However, the patented structure does not completely solve the transportation problem, while the structure of the Patent Application is not universally adjustable to accomodate all of the various sleep system sizes.

SUMMARY OF THE INVENTION

This invention is directed to a universal sleep system support which is readily collapsible for storage and transportation, and is easily assembled into a construction which can support any type and common size of sleep system. This universal sleep system support comprises a plurality of modules which when assembled are selectively locked together into a unitary construction. The modules each include readily assembled corner pieces and channel units. The corner pieces respectively have a planar surface and a leg structure extending substantially perpendicularly therefrom; and the channel units respectively have mating members slideably associated with one another for adjusting the length of the channel units. The channel units are selectively received by the corner pieces and adjusted to a preselected length to set the distance between such corner pieces. The assembled modules are selectively locked together into the unitary construction so that the channel units can support any type of sleep systems of any common size. In a further aspect of this invention, pairs of corner pieces are interconnected by adjustable brace members to provide structural rigidity therebetween. Also, the leg structures may include mechanisms for securing adjustable decorative panels thereto. The panels serve to give the universal support any desired appearance and may also provide a mounting means for an under-bed drawer storage assembly.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 1 is a view, in perspective of the universal sleep system support according to this invention;

FIG. 2 is a top plan view, on an enlarged scale, of one module of the sleep system support of FIG. 1;

DESCRIPTION OF THE PREFERRED EMBODIMENT

Figure 3:
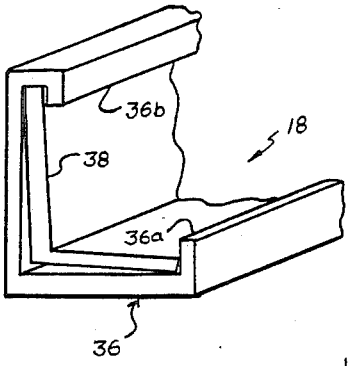
FIG. 3 is a view, in perspective, of a portion of a channel unit of the sleep system support module on an enlarged scale, taken along lines 3—3 of FIG. 2.

Referring now to the accompanying drawings, the universal sleep system support according to this invention is shown in FIG. 1 and designated generally by the numeral 10. The support 10 is made up of a plurality of individual modules 12. The modules 12, which are adjustable in the manner described hereinbelow, are located adjacent to one another and are secured together by any suitable locking mechanisms, such as clips 14. By adjustment of the modules, the universal support 10 may be arranged to accommodate the area of a sleep surface for any type and size of sleep system.

The structure of an individual one of the modules 12 is best shown in FIGS. 2–6. Particularly, a module 12 includes a plurality of corner pieces 16, a plurality of channel units 18 adjustably interconnecting such corner pieces, and if necessary, brace members 20 providing structural rigidity to the module (see FIG. 2). Each of the respective structural components of the module is substantially identically formed to simplify manufacture and facilitate assembly. Moreover, by making the modules 12 of such components, the universal support 10, when broken down into such components, can be packaged in a relatively small container to facilitate storage and transportation.

Turning now to a more detailed description of the structural components of a module 12, each of the corner piece 16 (see FIGS. 4 and 5) includes a planar member 22 having an upstanding marginal edge portion 24 and a leg structure 26 attached to such surface. These elements of the corner piece can be formed by sequential stamping operations on a sheet metal blank for example, or formed as individual elements and then welded or otherwise secured together. The planar member 22 has a pair of tabs 28 connected to the upper surface thereof. As shown, the tabs 28 are stamped from the material of the planar member 22; however they could be formed in any other suitable manner such as by being separately formed and the welded to the surface of the planar member 22. The tabs 28 are respectively directed toward perpendicular portions of the upstanding marginal edge 24 and are spaced a preselected distance therefrom to provide a receiving guide for the channel units 18. The planar member 22 also has a tab or pin 30 located at approximately the mid-point thereof and extending upwardly therefrom. The pin 30 provides a connection point for a brace member 20 if such member is required to provide additional structural rigidity to the module 12.

The leg structure 26 comprises a substantially vertical portion 26*a* in the shape of an angle iron and a base portion 26*b*. The vertical portion 26*a* is located inwardly of the upstanding marginal edge of the corner piece 16. In this manner the leg structures are recessed from the marginal perimeter of the corner pieces to provide a desireable toe kick (i.e., an area where a users foot may fit under the support 10 without stubbing of his/her toe on the leg structure). The leg structure 26 further includes a plurality of tabs 32 formed therein and extending outwardly therefrom. The tabs 32, which may be formed in the same manner as tabs 28 described above, provide a connection for decorative panels to be affixed to the module 12 as will be more fully described hereinbelow. The base portion 26*b* also has a tab or pin 34 formed therein. The pin 34 provides a connection point for a brace member 20 if such member is required to provide additional structural rigidity to the module 12.

Figure 5:
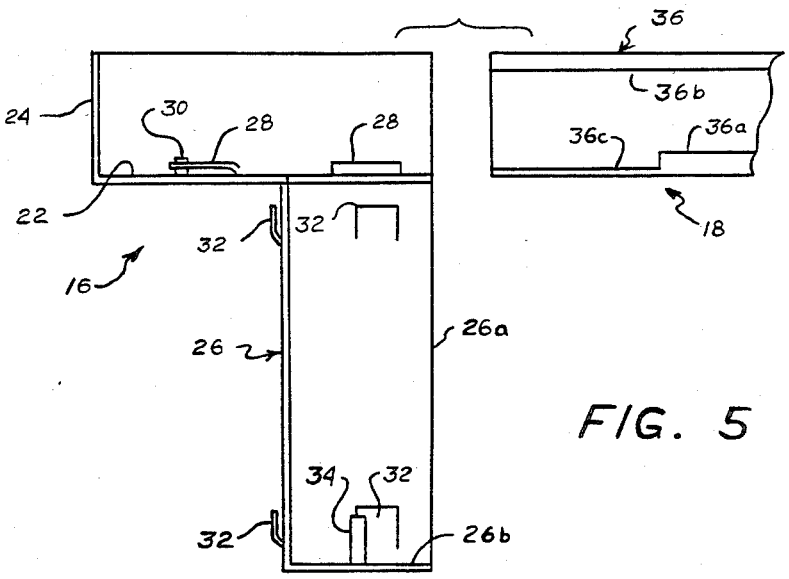
FIG. 5 is a side elevational view of the corner piece of FIG. 4, showing the location for the insertion of a channel unit therein.

The channel members 18 respectively include a pair of mating angle irons 36, 38 (see FIG. 3). The angle iron 36 has an upstanding lip 36*a* connected to the lower longitudinal portion thereof, and a down-turned lip 36*b* connected to the upper longitudinal portion thereof. The upper and lower portions of the angle iron 38 describe a slightly obtuse angle therebetween and have their outer edges engaging the lips 36*a* and 36*b*. In this manner the angle irons 36 and 38 can slide relative to one another for adjustment of the overall length of the channel unit, yet provide a structural rigidity to the channel unit to enable an assembled module to adequately support any type sleep system. As can be seen in FIG. 5, the lip 36*a* has a cut-out portion 36*c* which is slipped under a tab 28 of one corner piece 16 to secure one end of a channel unit 18 to such corner piece. The opposite end of such channel unit is secured to another corner piece by slipping the lower portion of angle iron 38 under a tab 28 of such corner piece. Relative sliding of the angle irons 36, 38 of the channel unit 18 enables the spacing between the associated corner pieces connected to the channel unit. Additional channel units and corner pieces are similarly assembled to form a module 12 with the channel units being adjusted so that the assembled module, when associated with other similarly assembled modules, is of a preselected size dependent on the size of the sleep surface to be supported.

Figure 6:
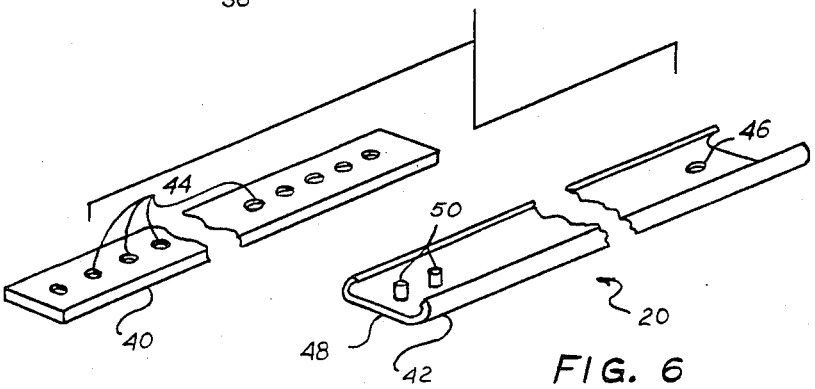
FIG. 6 is an exploded view, in perspective and on an enlarged scale, of an adjustable brace for the interconnecting corner pieces such as shown in FIGS. 4 and 5 to provide structural rigidity therebetween.

As noted above, if additional structural rigidity for a module 12 is required, the module may incorporate brace members 20. While any suitable brace member may be used with this invention, the preferred brace member 20, as shown in FIG. 6, includes first and second elongated members 40 and 42. The member 40 is a substantially flat plate and has a plurality of longitudinally spaced openings 44. On the other hand, the member 42 is channel-shaped to slidably receive member 42. One end of the member 42 has an opening 46 while the opposite end 48 has a plurality of upstanding pins 50. On assembly, the member 40 is slid into the member 42 until the overall length of the brace is substantially equal to the distance between oppositely disposed corner pieces. The opening 46 in the member 42 is fitted over a pin 30 or 34, and most remote of the openings 44 in the member 40 is fitted over a corresponding pin in the opposite corner piece. A pair of the openings 44 will then be positioned to fit over the pins 50 and can be locked in place over such pins to provide the desired structural rigidity between the opposed corner pieces. Of course additional brace members can be similarly assembled between alternate corner pieces, leg structures, or both depending upon the degree of structural rigidity required.

When the assembled modules 12 are placed in relative association and locked together, for example by clips 14, to form the sleep system support of the desired size, such support is capable of accomodating any type of sleep system. For example, a conventional sleep system can be supported on the marginal perimeter channel units and corner pieces in a similar manner as accomplished by presently known conventional sleep system support frames; or to support a floatation or hybrid sleep system, well known deck material may be laid up within the channel units of each module to provide the required weight distribution for the fluid-filled bladder of such latter sleep systems. Thus, the sleep system support 10 according to this invention may truely be referred to as universal in that it can accommodate any type of sleep system of any common size.

Figure 7:
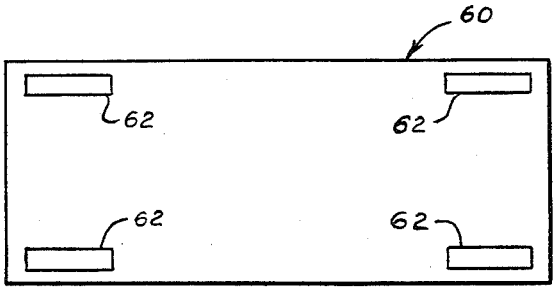
FIG. 7 is rear elevational view of a side panel for a sleep system support module, particularly showing the brackets for adjustably joining the panel to a module.
Figure 4:
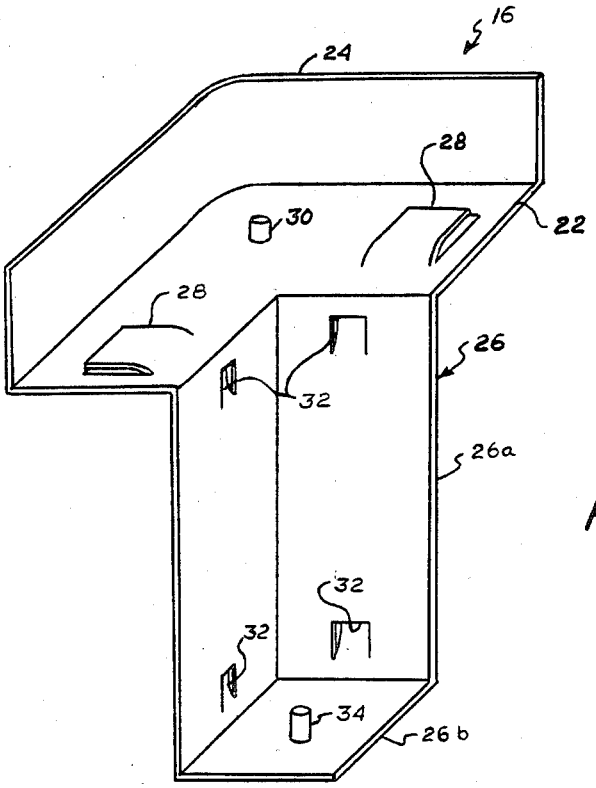
FIG. 4 is a view, in perspective and on an enlarged scale, of a corner piece for the sleep system support module of FIG. 2.
Figure 8:
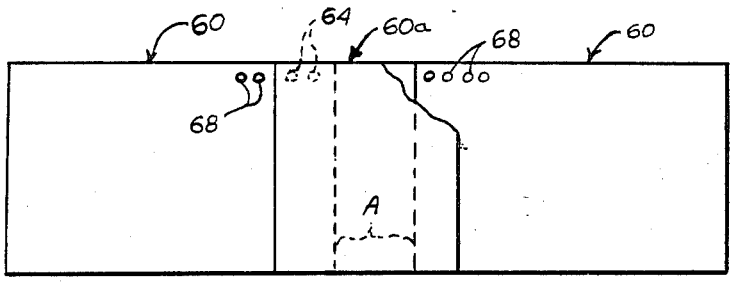
FIG. 8 is a front elevational view of a plurality of panels of the type shown in FIG. 7 showing their interrelation to decoratively enclose the interrelated sleep system support modules of FIG. 1.

The universal sleep system support 10 according to this invention has a further advantage in that it can be finished to assume any desired external appearance. That is to say, panels of any particular design can be readily attached to the modules 12 to give the support 10 a desired look or functionality. The panels can be faced with a fabric-like material similar to material found on mattresses of conventional bedding to give the support 10 the appearance of a conventional bed set. Alternatively the panels can be formed of a wood or wood-like structure or can be faced with a material having a wood-like appearance to give the support 10 the look of a typical floatation sleep system support pedestal. FIGS. 7 and 8 show a panel 60 for use with the support 10 according to this invention. The panels 60 each include, on the rear face thereof, a plurality of brackets 62. The brackets 62 are adapted to be fitted over the tabs 32 on the leg structures of a module 12 to secure the panel to the leg structure. While the panels 60 may be formed of a preselected size corresponding to each size of the sleep system to be accommodated by the support 10, preferrably these panels are all made of similar dimension to facilitate manufacture and ease of assembly. It is then necessary that the brackets 62 be relatively elongated so that, within normal limits, they can mate with the tabs 32, no matter how far the leg structures are spaced apart (for accommodating the various sleep sytem sizes). This arrangement also requires the use of a filler panel 60*a* (see FIG. 8) to span the opening A between panels 60 secured to adjacent modules 12. The filler panels 60*a*, having the same outer appearance as the panels 60 with which they are associated, are secured to such panels by any well known mechanism. For example, each of the panels 60*a* may have a pin or threaded stud 64 attached to the rear face thereof. Such stud is receivable in one of a series of holes 68 in the panels 60, depending upon the distance between the panels 60 which must be spanned by the panel 60*a*. When the studs are secured in the holes, the panels 60*a* are held in position relative to the panels 60 to fill in the sides of the support 10 and give such support the desired finished appearance.

Figure 9:
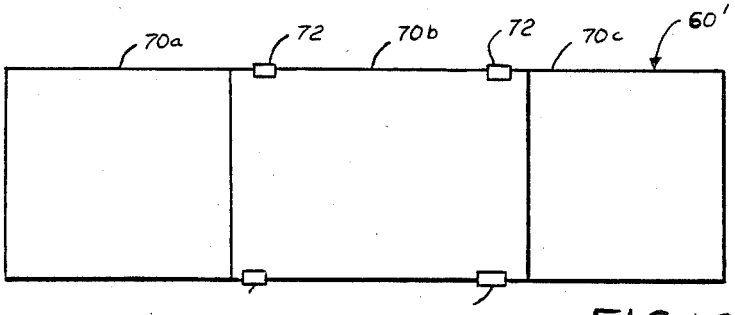
FIG. 9 is a front elevational view of an alternate end-enclosing panel for the interrelated sleep system support modules of FIG. 1.
Figure 10:
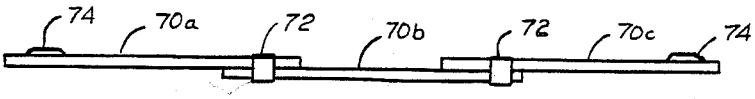
FIG. 10 is a top view of the alternate end-enclosing panel of FIG. 9, particularly showing the adjustability of such panel to accomodate different dimensions of the interrelated modules of FIG. 1.

An alternate panel 60′ for enclosing the ends of the universal sleep system support 10 according to this invention is shown in FIGS. 9 and 10. The panel 60′ includes three relatively adjustable sections 70*a*, 70*b*, and 70*c* of any desired external appearance as described above with reference to panel 60. Of course, two or more sections for the panel 60′ would be suitable for use with this invention. The sections 70*a*, 70*b*, 70*c* are joined for relative sliding movement by clips 72 for example. The outboard sections 70*a* and 70*c* have brackets 74 (similar to brackets 62) fixed to the rear faces thereof. The sections of the panel 60′ are relatively adjusted to the size of the sleep system support 10 with which such panel is to be associated such that the brackets 74 can be attached to the tabs 32 on the leg structures 26 of adjacent modules 12 of such sleep system support. The panel 60′ is then held in position by such attachment to give the sleep system support 10 the desired finished appearance.

Figure 11:
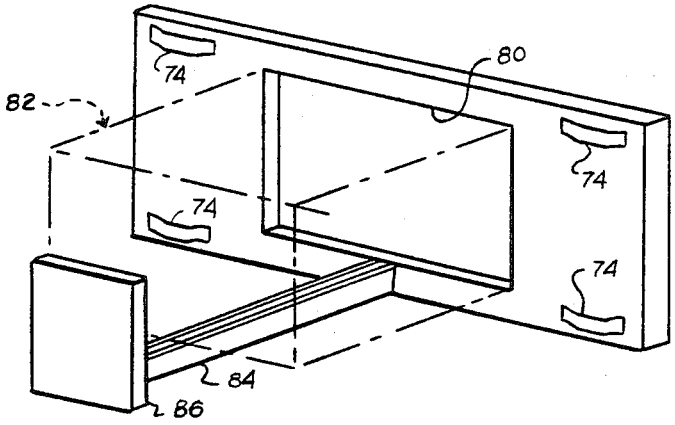
FIG. 11 is a rear view, in perspective, of an alternate panel for the interrelated sleep system support modules incrporating a drawer assembly.

Another alternate panel, designated by the numeral 60″ as shown in FIG. 11, enables the universal sleep system support according to this invention to be adapted to include an under-bed storage assembly. The panel 60″, and its associated structure as described immediately below, may replace any one or more of the panels 60 depending on the number of drawers desired for the under-bed storage assembly. The panel 60″, having any desired external appearance, is provided with an opening 80 through which a drawer 82 (shown in phantom) may pass. Support for the drawer 82, and guiding thereof relative to the panel, can be accomplished by any well known drawer guide mechanism. However a preferred guide mechanism includes an inverted "T"-grooved track 84 attached to the rear face of the panel 60″ and extending substantially perpendicular therefrom. The end of the track remote from the panel 60″ is fixed to a block 86. The size of the block 86 is selected to have a width to establish a secure base for the track to prevent the track from twisting or otherwise moving from its desired location. A mating slider (not shown) located on the bottom of the drawer 82 is slideable in the track 84 to both support the drawer and enable it to move outwardly for access to the interior of the drawer. If required additional drawer guides may be provided such as by attachment of such guides adjacent to the corners of the opening 80. Of course, the front of the drawer 82 will have any particular appearance to give the sleep system support 10 a desired finished look.

The invention has been described in detail with particular reference to a preferred embodiment thereof, but it will be understood that variations and modifications can be effected within the spirit and scope of the invention.

I claim:

1. A universal sleep system support readily collapsible for storage and transportation, and easily assembled, said support comprising:

a plurality of readily assembled modules, each of said modules including: (1) a plurality of corner pieces respectively having a planar surface and a leg structure extending substantially perpendicularly therefrom, (2) a plurality of channel units respectively having mating members in slideable association for adjusting the length of said channel units, and (3) means for receiving and holding said channel units in fixed relationship to said corner pieces; and means for selectively locking assembled modules together into a unitary construction so that, upon adjustment of said channel members, said modules provide support for any type and common size sleep system.

2. The invention of claim 1 wherein said mating members of said channel units include a first angle iron having lips respectively extending from the longitudinal portions thereof, and a second angle iron slideably received between said lips of said first angle iron.

3. The invention of claim 2 wherein said means for receiving and holding said channel unit include a plurality of tabs extending from said planar surface of each of said corner pieces.

4. The invention of claim 3 wherein a longitudinal portion of said first angle iron of a channel unit is received by a tab of one corner piece and held thereto, and a longitudinal portion of said second angle iron of such channel unit is received by a tab of a second corner piece and held thereto, whereby relative sliding adjustment of said angle irons establishes the distance at which such corner pieces are spaced apart.

5. The invention of claim 1 further including adjustable means for interconnecting selected oppositely disposed corner pieces to provide structural rigidity therebetween.

6. The invention of claim 1 further including a plurality of panels connected to said assembled modules, said panels having a preselected external design to give said sleep system support a desired finished appearance.

7. The invention of claim 6 wherein said leg structures of said respective corner pieces each include a plurality of tabs extending outwardly therefrom and said panels include a plurality of brackets respectively receivable by said tabs to secure said panels thereto.

8. The invention of claim 7 wherein each of said leg structures is located inwardly of the marginal perimeter of the corner piece with which it is associated, whereby said leg structures are recessed with respect to the marginal perimeter of said corner pieces to provide a suitable toe kick.

9. The invention of claim 6 wherein each of said panels includes a plurality of sections interconnected for slideable movement to enable such panel to be adjusted to the size of the sleep system support with which it is associated.

10. The invention of claim 6 wherein at least one of said panels has an opening defined therein, and means attached to said panel for receiving and guiding a drawer assembly so as to adapt said sleep system support to provide for under-bed storage.

* * * * *